US012733778B2

(12) United States Patent
Cheng et al.

(10) Patent No.: US 12,733,778 B2
(45) Date of Patent: Sep. 15, 2026

(54) DUST SUCTION DEVICE WITH STORAGE STATE

(71) Applicant: X'POLE PRECISION TOOLS INC., Taoyuan (TW)

(72) Inventors: Ding-Yao Cheng, Taoyuan (TW); Huan-Chun Tseng, Taoyuan (TW); Wen-Hsien Su, Taoyuan (TW)

(73) Assignee: X'POLE PRECISION TOOLS INC., Taoyuan City (TW)

( * ) Notice: Subject to any disclaimer, the term of this patent is extended or adjusted under 35 U.S.C. 154(b) by 574 days.

(21) Appl. No.: 18/173,621

(22) Filed: Feb. 23, 2023

(65) Prior Publication Data

US 2024/0285135 A1 Aug. 29, 2024

(51) Int. Cl.

| | |
|---|---|
| ***A47L 5/36*** | (2006.01) |
| ***A47L 9/00*** | (2006.01) |
| ***A47L 9/14*** | (2006.01) |
| ***A47L 9/32*** | (2006.01) |

(52) U.S. Cl.

CPC ..... *A47L 5/365* (2013.01); *A47L 9/0018* (2013.01); *A47L 9/1409* (2013.01); *A47L 9/1463* (2013.01); *A47L 9/327* (2013.01)

(58) Field of Classification Search

CPC ..... A47L 5/365; A47L 9/22

See application file for complete search history.

(56) References Cited

U.S. PATENT DOCUMENTS 2,722,994 A * 11/1955 Fisker ..... A47L 9/20 15/327.6
3,570,222 A * 3/1971 Dudek et al. ..... A47L 7/0038 55/504
3,618,297 A * 11/1971 Hamrick ..... A47L 7/0047 15/104.062
5,440,780 A * 8/1995 Rakocy ..... A47L 5/00 15/327.2
6,022,055 A * 2/2000 Coulonvaux ..... F16B 2/185 24/270

(Continued)

FOREIGN PATENT DOCUMENTS

CN 103961025 A 8/2014
CN 209404622 U 9/2019

(Continued)

*Primary Examiner* — Bryan R Muller

(74) *Attorney, Agent, or Firm* — Muncy, Geissler, Olds & Lowe, P.C.

(57) ABSTRACT

A dust suction device includes a dust collection barrel, a supporting ring and a dust suction assembly, the barrel includes an inner space, an assembling opening communicating with the space, and at least two connectors disposed on the barrel, the opening has an opening diameter. The ring is placed at the opening, and has a ring outer diameter larger than the opening diameter, and a ring inner diameter. The assembly includes a shell and at least two connecting structures formed on an outer surface of the shell and used to restrict the assembly from separating from the barrel, the shell has at least one shell outer diameter smaller than the opening diameter, but larger than the ring inner diameter, the assembly has a use state by using the ring as a base and stacked above the barrel, and a storage state of being placed in the space.

10 Claims, 8 Drawing Sheets

(56) References Cited

U.S. PATENT DOCUMENTS

| | | | | |
|---|---|---|---|---|
| 6,484,351 | B2 * | 11/2002 | Griffin | A47L 5/14 15/329 |
| 6,530,116 | B2 * | 3/2003 | Berfield | A47L 5/365 15/328 |
| 8,567,828 | B2 * | 10/2013 | Andren | E05C 19/14 292/113 |
| 9,198,552 | B2 * | 12/2015 | Wolfe | A47L 7/0071 |
| 11,291,339 | B2 * | 4/2022 | Dorman | A47L 7/0019 |
| 2003/0145426 | A1 * | 8/2003 | Fernandez-Grandizo Martinez | A47L 5/365 15/413 |
| 2010/0162516 | A1 * | 7/2010 | Gierer | A47L 5/22 15/339 |
| 2011/0247170 | A1 * | 10/2011 | Jones | A47L 7/0047 15/347 |
| 2019/0133392 | A1 * | 5/2019 | Rolland | A47L 7/0085 |

FOREIGN PATENT DOCUMENTS

| | | | |
|---|---|---|---|
| CN | 110811414 | A | 2/2020 |
| CN | 111588306 | A | 8/2020 |
| CN | 211933876 | U | 11/2020 |
| WO | WO2020011238 | A | 1/2020 |

* cited by examiner

DUST SUCTION DEVICE WITH STORAGE STATE

FIELD OF THE INVENTION

The invention relates to a dust suction device, and particularly to a dust suction device with a storage state.

BACKGROUND OF THE INVENTION

Patents such as Chinese Patent Nos. CN 103961025A, WO 2020011238A, CN 110811414A, CN 111588306A, CN 211933876U and CN 209404622U disclose the technique for storing a dust suction device.

Taking Chinese Patent No. CN 103961025A as an example, Chinese Patent No. CN 103961025A describes that the main structure of the dust suction device comprises a dust collection barrel and a body element, the body element has a head housing stacked on the dust collection barrel, a motor disposed in the head housing, a filter element located in the dust collection barrel, and a quick-installation structure disposed on the head housing, the quick-installation structure enables the dust suction device to switch between a first state and a second state. Wherein, in the second state, the filter element is connected to the head housing, and the head housing is stacked above the dust collection barrel through the quick-installation structure, so that the dust suction device can perform a dust suction operation; in the first state, the filter element is removed from the head housing, and is independently placed in the dust collection barrel relative to the head housing, and the head housing is suspended on the opening of the dust collection barrel in an upside down posture through the quick-installation structure, so that the head housing is accommodated in the dust collection barrel. However, when the conventional dust suction device enters the first state, the head housing and the motor will be suspended on the opening of the dust collection barrel at the same time, causing the quick-installation structure to bear a considerable weight. When the structural stability of the quick-installation structure is insufficient, it is easy to cause the head housing to collide with the filter element accommodated in the dust collection barrel. Furthermore, the storage method of the conventional dust suction device is likely to make some components on the head housing still expose outside the dust collection barrel, resulting in the head housing cannot be completely accommodated.

SUMMARY OF THE INVENTION

A main object of the invention is to solve the problem that conventional dust suction devices are not conducive to storage.

In order to achieve the above object, the invention provides a dust suction device with a storage state, the dust suction device comprises a dust collection barrel, a supporting ring and a dust suction assembly, the dust collection barrel comprises a barrel inner space, an assembling opening communicating with the barrel inner space, and at least two connectors disposed on an outer surface of the dust collection barrel and adjacent to the assembling opening, and the assembling opening has an opening diameter. The supporting ring is placed at the assembling opening, the supporting ring includes a ring outer diameter larger than the opening diameter, and a ring inner diameter. The dust suction assembly comprises a shell, and at least two connecting structures formed on an outer surface of the shell, the at least two connecting structures are provided for assembling with the at least two connectors to restrict the dust suction assembly from separating from the dust collection barrel, the shell has at least one shell outer diameter, the at least one shell outer diameter is smaller than the opening diameter, the at least one shell outer diameter is larger than the ring inner diameter, the dust suction assembly has a use state that the supporting ring is provided as a base of the dust suction assembly to stack the dust suction assembly above the dust collection barrel, and a storage state of being placed in the barrel inner space.

In one embodiment, the supporting ring includes an auxiliary positioning rib disposed on a side facing the dust suction assembly.

In one embodiment, the supporting ring has includes assembly groove disposed on a side facing the dust collection barrel and matched with the assembling opening, and an airtight element disposed in the assembly groove.

In one embodiment, the at least two connecting structure comprises a groove formed on the shell, and a connecting protrusion formed in the groove and cooperating with one of the at least two connectors.

In one embodiment, the shell comprises a barrel-shaped cover and a bottom plate matched with the barrel-shaped cover, and the bottom plate includes at least one air vent communicating with the barrel inner space.

In one embodiment, the bottom plate has a plurality of supporting ribs disposed around the air vent, and a secondary air passage plate connected to the plurality of supporting ribs and facing the air vent, and a plurality of through holes are formed on the secondary air passage plate.

In one embodiment, the dust suction assembly comprises a handle mounted on the shell, and the shell includes an accommodating groove accommodating the handle.

In one embodiment, each of the at least two connectors comprises a base fixed on the outer surface of the dust collection barrel, a bridge pivotally connected on the base, and a hook connected to the bridge.

In one embodiment, the hook comprises a straight section connected to the bridge, an oblique section connected to the straight section, and a hook-shaped section connected to the oblique section.

In one embodiment, the barrel inner space has at least one barrel inner diameter, and the at least one barrel inner diameter is greater than or equal to the opening diameter.

Through the aforementioned implementation of the invention, the invention has the following features compared with the conventional technique: the invention facilitates transportation of the dust suction device by reducing its volume when it is not in use through disposition of the supporting ring. At the same time, through the design of the supporting ring, when the dust suction device enters the storage state, the dust suction assembly is placed into the barrel inner space and is completely stored in the dust collection barrel.

DETAILED DESCRIPTION OF THE PREFERRED EMBODIMENTS

Figure 1:
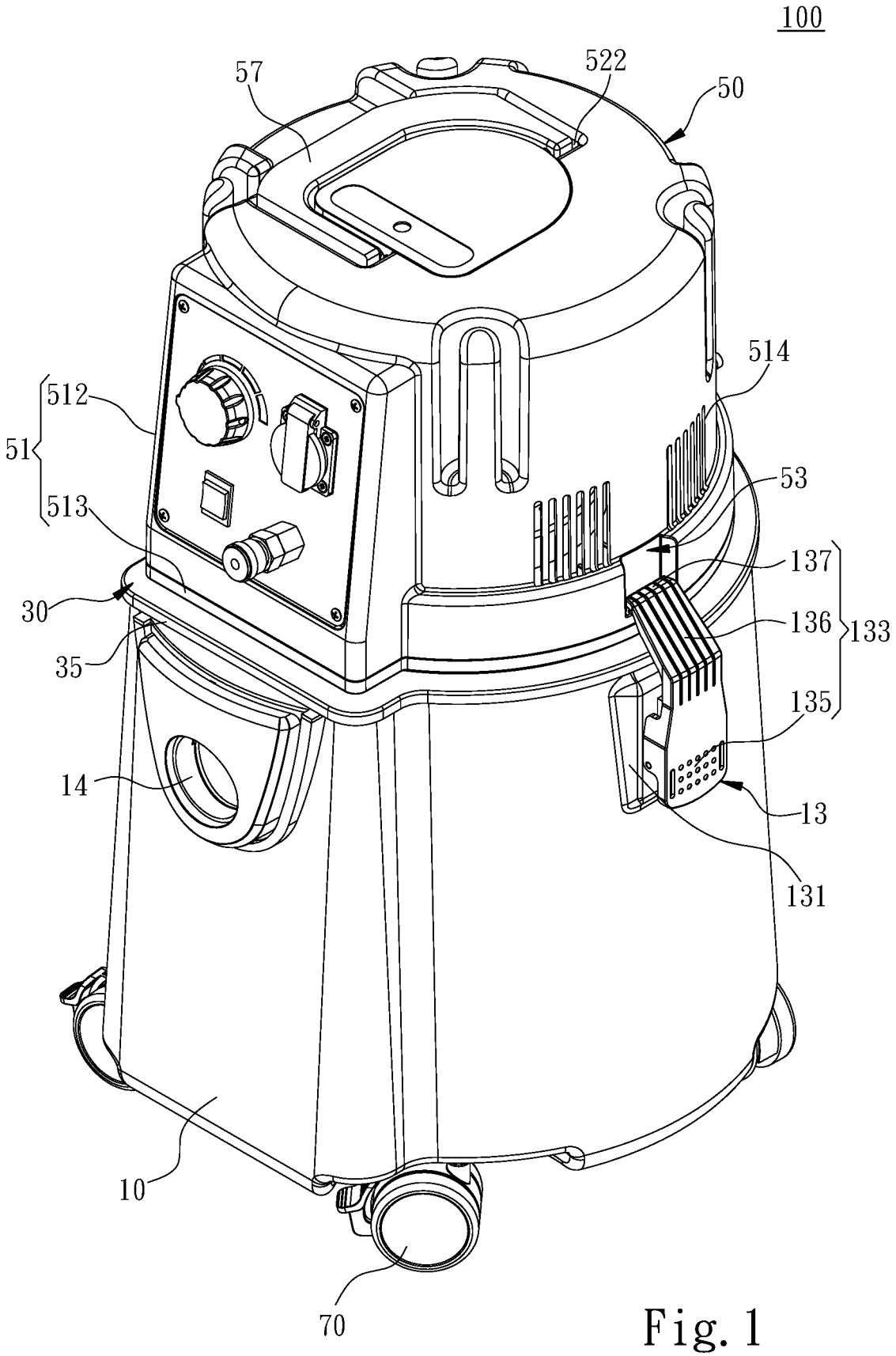
FIG. 1 is a perspective view of an embodiment of the invention.

The detailed description and technical content of the invention are described below with reference to the accompanying drawings. Please refer to FIG. 1, FIG. 2, FIG. 3, FIG. 4, and FIG. 5, the invention provides a dust suction device 100 with a storage state, which comprises a dust collection barrel 10, a supporting ring 30 and a dust suction assembly 50. The dust collection barrel 10 collects dust. The dust collection barrel 10 includes a barrel inner space 11, an assembling opening 12 communicating with the barrel inner space 11, and at least two connectors 13 disposed on a surface of the dust collection barrel 10, wherein the assembling opening 12 is defined by at least one shell top edge (indicated by reference number 101 in FIG. 6) of the dust collection barrel 10, the assembling opening 12 is an opening of the dust collection barrel 10, the assembling opening 12 exposes the barrel inner space 11 to be open, and the assembling opening 12 has an opening diameter (indicated by reference number 121 in FIG. 7). In addition, the at least two connectors 13 is to provide assembly. The at least two connectors 13 are disposed adjacent to the assembling opening 12. Adjacent disposition means that the at least two connectors 13 are located on a side of the surface of the dust collection barrel 10 close to the assembling opening 12, and the at least two connectors 13 are in positions that provide assembly. The invention does not specifically limit disposed positions of the at least two connectors 13. Moreover, the supporting ring 30 is an independent component relative to the dust collection barrel 10, the supporting ring 30 is optionally disposed on the dust collection barrel 10, and is separately disposed on the dust collection barrel 10. The supporting ring 30 has a ring inner diameter 31 and a ring outer diameter 32, the ring inner diameter 31 is larger than the opening diameter 121, so that when the supporting ring 30 is assembled with the dust collection barrel 10, the supporting ring 30 is assembled on the at least one shell top edge 101, and is placed at the assembling opening 12. Furthermore, the dust suction assembly 50 comprises a shell 51, and at least two connecting structures 53 formed on an outer surface of the shell 51. The shell 51 is optionally assembled with the supporting ring 30, when the shell 51 is connected with the supporting ring 30, the shell 51 is positioned above the dust collection barrel 10; when the shell 51 is separated from the supporting ring 30, the shell 51 is removed from the dust collection barrel 10. The at least two connecting structures 53 correspond to the at least two connectors 13, and the at least two connecting structures 53 are provided for assembling with the at least two connectors 13 to restrict the dust suction assembly 50 from separating from the dust collection barrel 10 when in use. Further, the shell 51 has at least one shell outer diameter 511, and the at least one shell outer diameter 511 is smaller than the opening diameter 121 but larger than the ring inner diameter 31. In one embodiment, when the shell outer diameter 511 is a constant, it means that the shell 51 has no change in outer diameter. In another embodiment, when a plurality of shell outer diameters 511 are provided, it means that the shell 51 has changes in outer diameter, and each of the plurality of shell outer diameters 511 is smaller than the opening diameter 121, but larger than the ring inner diameter 31.

Figure 5:
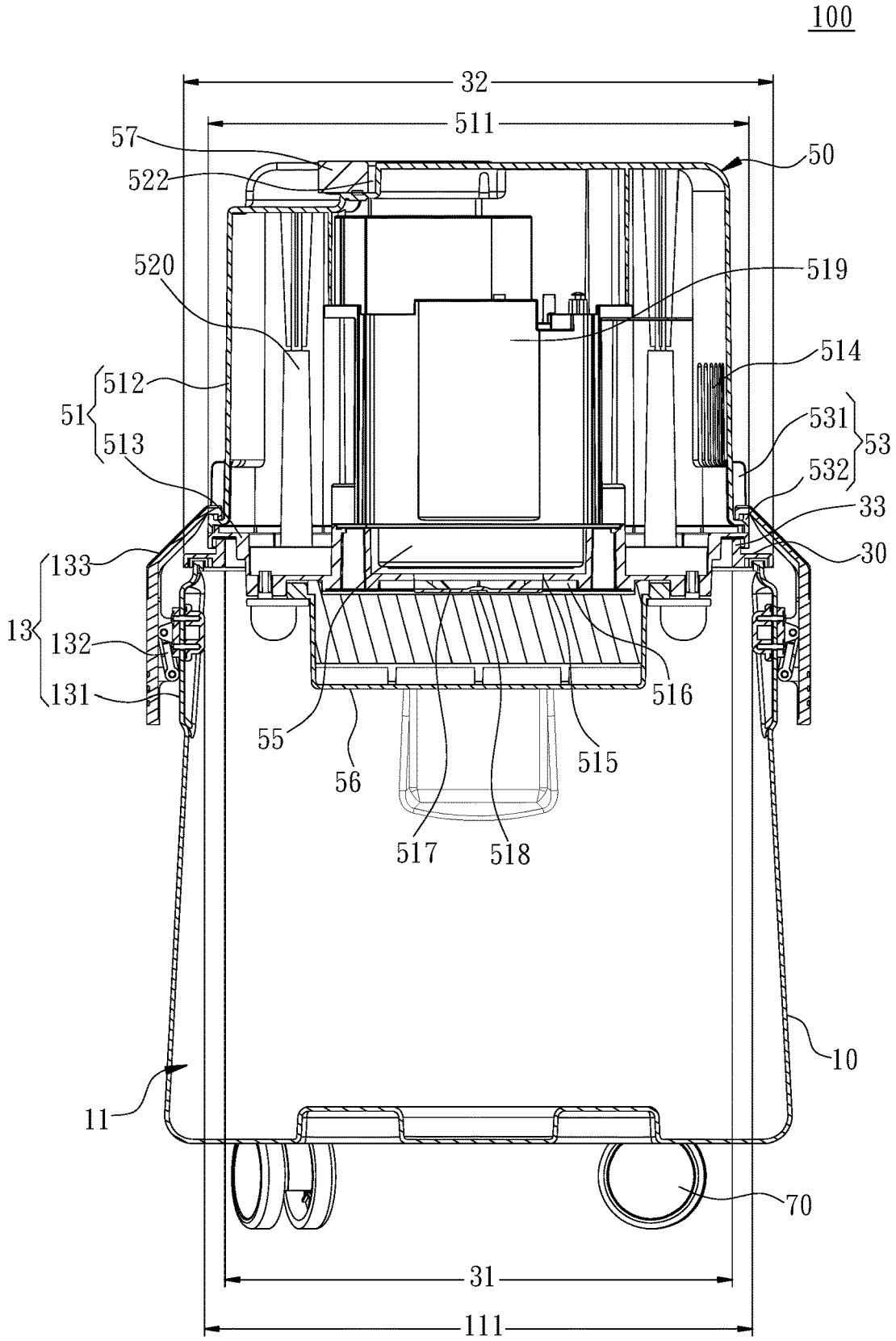
FIG. 5 is a cross-sectional view of the embodiment of the invention.
Figure 6:
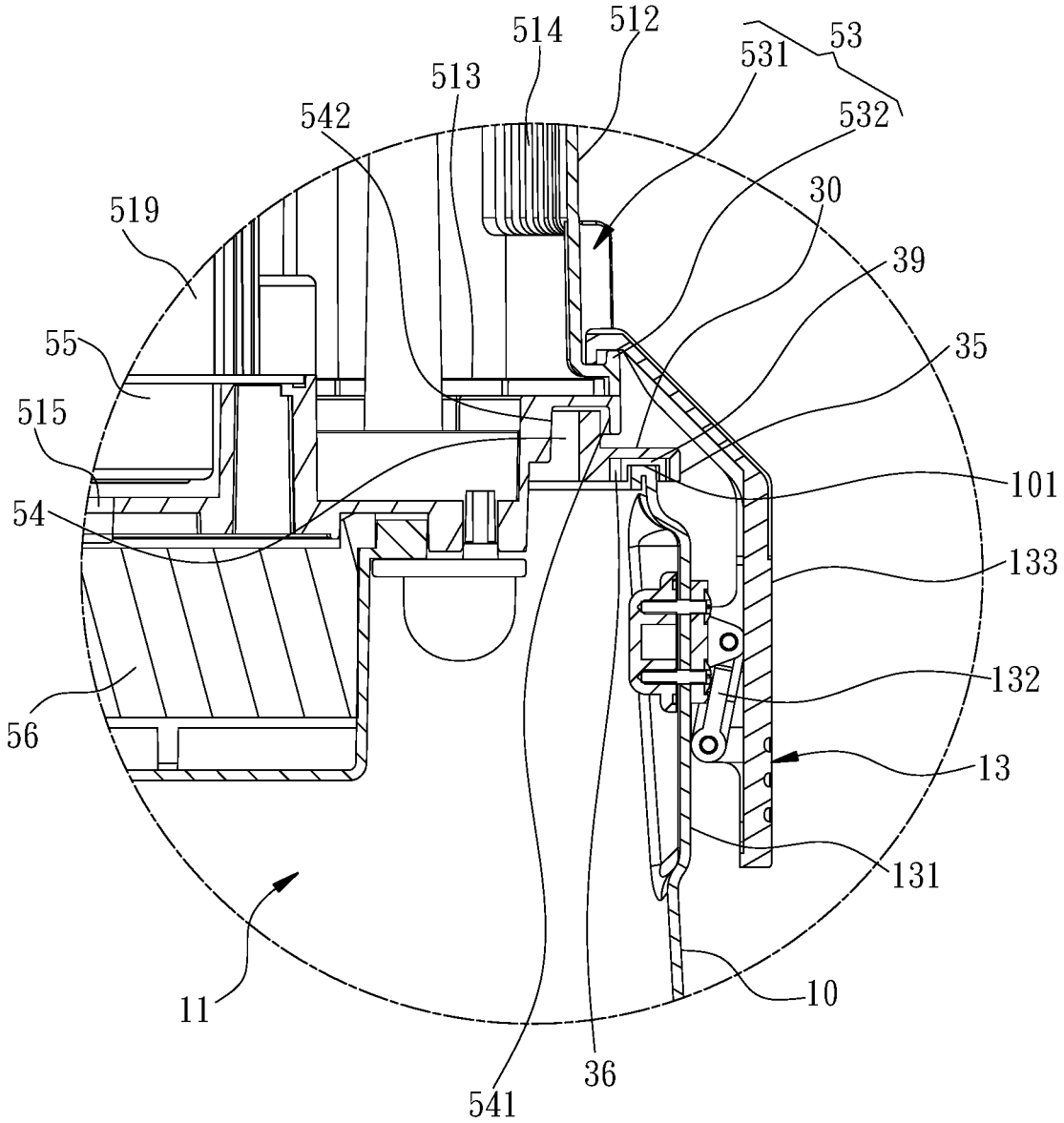
FIG. 6 is an enlarged diagram of partial structures of the embodiment of the invention.
Figure 7:
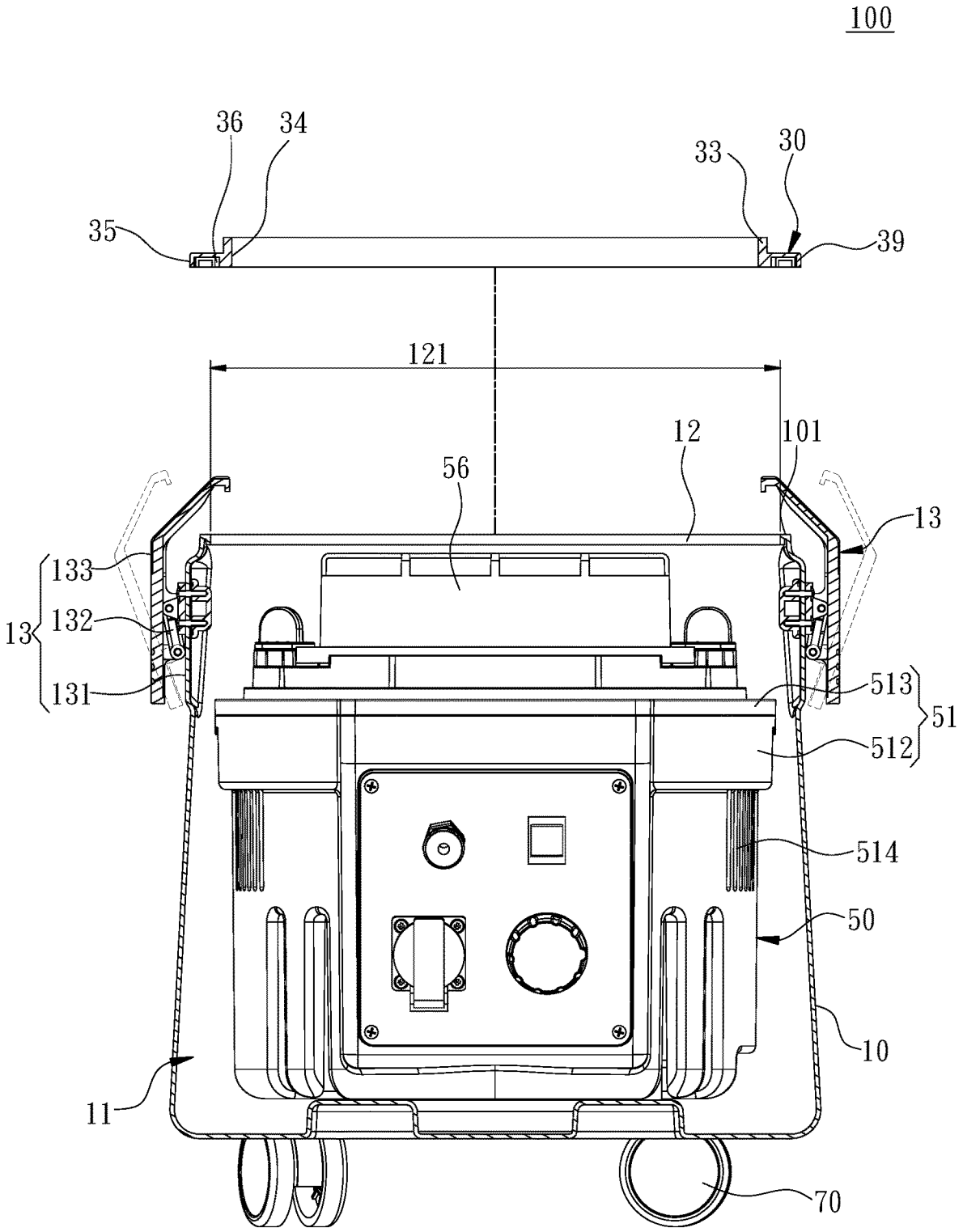
FIG. 7 is a first schematic diagram of implementation state of the embodiment of the invention.
Figure 8:
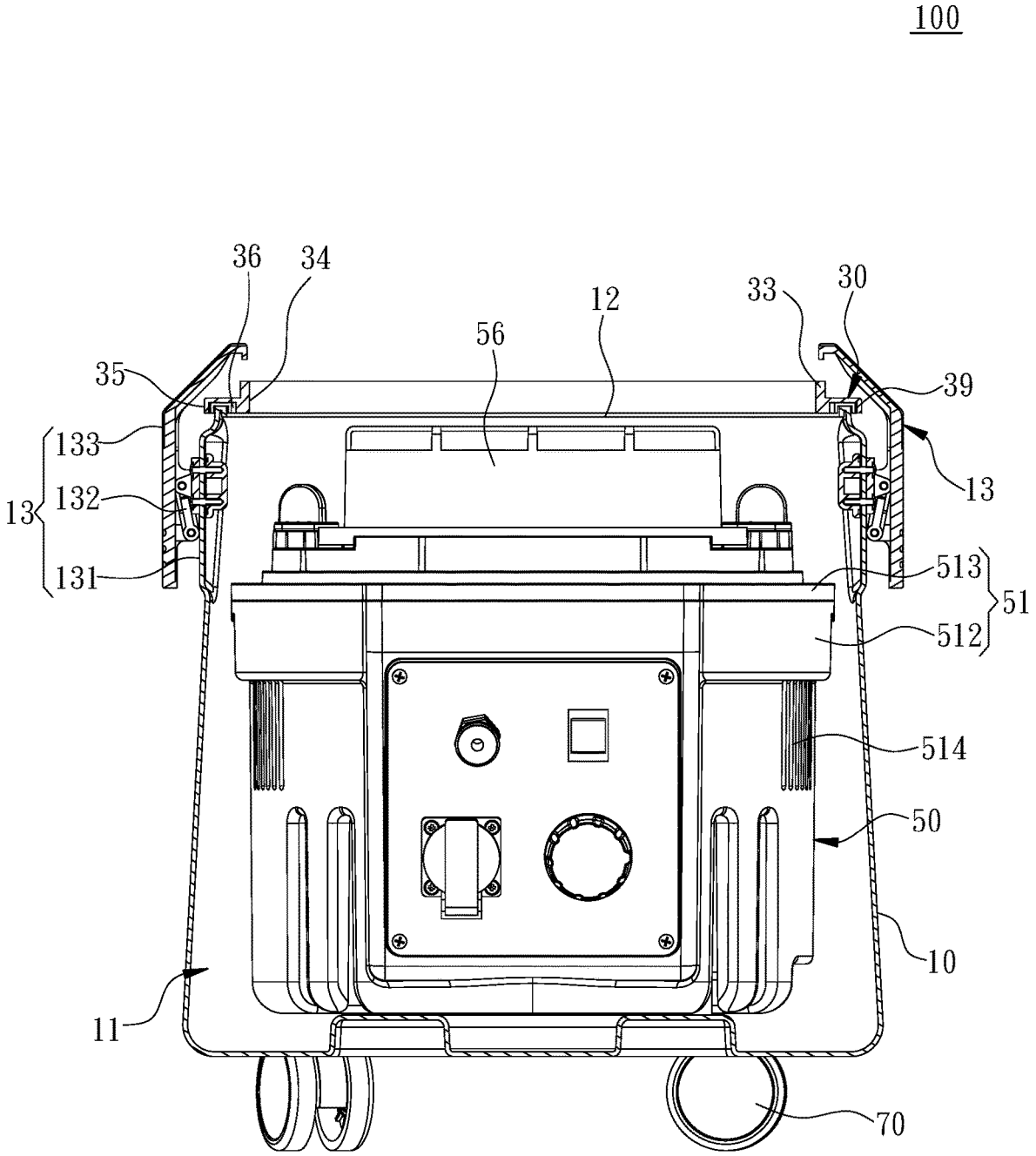
FIG. 8 is s second schematic diagram of implementation state of the embodiment of the invention.

Please refer to FIG. 5, FIG. 6, FIG. 7, and FIG. 8, the dust suction assembly 50 has a use state located above the dust collection barrel 10, and a storage state placed in the barrel inner space 11. In the use state, the supporting ring 30 is placed at the assembling opening 12, the shell 51 is stacked on the supporting ring 30. The supporting ring 30 is provided as a base of the dust suction assembly 50 to stack the dust suction assembly 50 above the dust collection barrel 10. At this time, the dust suction device 100 performs a dust suction operation, in the storage state, the supporting ring 30 is removed from the assembling opening 12, and the shell 51 is no longer restricted by the ring inner diameter 31 of the supporting ring 30, so that the dust suction assembly 50 is placed into this barrel inner space 11. Further, the dust suction assembly 50 is placed upright in the barrel inner space 11, or the dust suction assembly 50 is placed upside down in the barrel inner space 11. It should be noted that after the dust suction assembly 50 is placed into the barrel inner space 11, a level of a top edge of the dust suction assembly 50 is lower than a level of the assembling opening 12, that is, the top edge of the dust suction assembly 50 does not exceed the assembling opening 12, and the dust suction assembly 50 is completely accommodated in the barrel inner space 11, as shown in FIG. 7. After the dust suction assembly 50 is placed into the barrel inner space 11, the supporting ring 30 is placed on the assembling opening 12 again to complete storage of the dust suction device 100. Moreover, if the dust suction assembly 50 is to be transferred from the storage state to the use state again, the dust suction assembly 50 is taken out from the barrel inner space 11, and the supporting ring 30 is placed at the assembling opening 12 again, so that the dust suction assembly 50 is again stacked above the dust collection barrel 10, and the supporting ring 30 is provided as a base of the dust suction assembly 50.

It is known from the above that the at least one shell outer diameter 511 of the shell 51 of the invention is smaller than the opening diameter 121, so that when the dust suction assembly 50 is in the use state, the dust suction assembly 50 cannot be placed above the dust collection barrel 10 alone. The dust suction assembly 50 is stacked on the dust collection barrel 10 through disposing and using the supporting ring 30 as a base. When the dust suction assembly 50 enters the storage state, after the dust suction assembly 50 is placed in the barrel inner space 11, the top edge of the dust suction assembly 50 does not exceed the assembling opening 12, so that the dust suction assembly 50 will not be exposed outside of the dust collection barrel 10 in order to reduce a volume of the dust suction device 100 and facilitate transportation of the dust suction device 100. Compared with the conventional technique, the invention is more than simply stores a body component upside down, but completely stores the dust suction assembly 50 in the dust collection barrel 10, and effectively solves the problem of relying on a quick-installation structure to suspend a head housing on the conventional dust suction devices.

Please refer to FIG. 5, FIG. 6, FIG. 7, and FIG. 8, in one embodiment, the barrel inner space 11 of the invention has at least one barrel inner diameter 111, and the at least one barrel inner diameter 111 is greater than or equal to the opening diameter 121, in other words, the at least one barrel inner diameter 111 is at least equal to the opening diameter 121 of the assembling opening 12, so that the dust suction assembly 50 is accommodated in the barrel inner space 11.

Furthermore, when the barrel inner diameter 111 in the invention is a constant, it means that the barrel inner space 11 does not have a change in inner diameter and is in a straight cylindrical shape. In another embodiment, when a plurality of the barrel inner diameters 111 are provided, it means that the barrel inner space 11 has changes in inner diameter.

In order for the invention to stabilize assembling the supporting ring 30 with the shell 51, in one embodiment, the supporting ring 30 includes an auxiliary positioning rib 33 disposed on a side facing the dust suction assembly 50, the shell 51 includes a positioning groove 54 matched with the auxiliary positioning rib 33, and the positioning groove 54 is provided for the auxiliary positioning rib 33 to dispose therein. Further, the supporting ring 30 includes an inner ring edge 34 defining the ring inner diameter 31, and an outer ring edge 35 defining the ring outer diameter 32, and the auxiliary positioning rib 33 is disposed close to the inner ring edge 34, more specifically, one side surface of the auxiliary positioning rib 33 is coplanar with the inner ring edge 34. In another embodiment, the two inner walls (indicated by reference numerals 541 and 542) of the positioning groove 54 located on two opposite sides of the auxiliary positioning rib 33 are of different lengths.

In order for the invention to stabilize assembling the supporting ring 30 with the dust collection barrel 10, in one embodiment, the supporting ring 30 includes an assembly groove 36 located on a side facing the dust collection barrel 10. The assembly groove 36 matches with the at least one shell top edge 101, so that the supporting ring 30 is stably placed on the assembling opening 12. In more detail, the supporting ring 30 comprises a ring body 37 provided with the inner ring edge 34, and an extension portion 38 connected to the ring body 37, a shape of the ring body 37 matches with the shell 51 to enable the dust suction assembly 50 to be placed on the supporting ring 30, and the extension portion 38 and the ring body 37 jointly form the assembly groove 36, so that the assembly groove 36 matches with the at least one shell top edge 101 of the dust collection barrel 10. In addition, in order to maintain airtightness in the invention, the supporting ring 30 includes an airtight element 39 disposed in the assembly groove 36, and the airtight element 39 is assembled with the at least one shell top edge 101 of the dust collection barrel 10, thereby forming airtightness inside the dust collection barrel 10, so that dust in the dust collection barrel 10 is prevented from coming out when the dust suction device 100 is operating.

Figure 2:
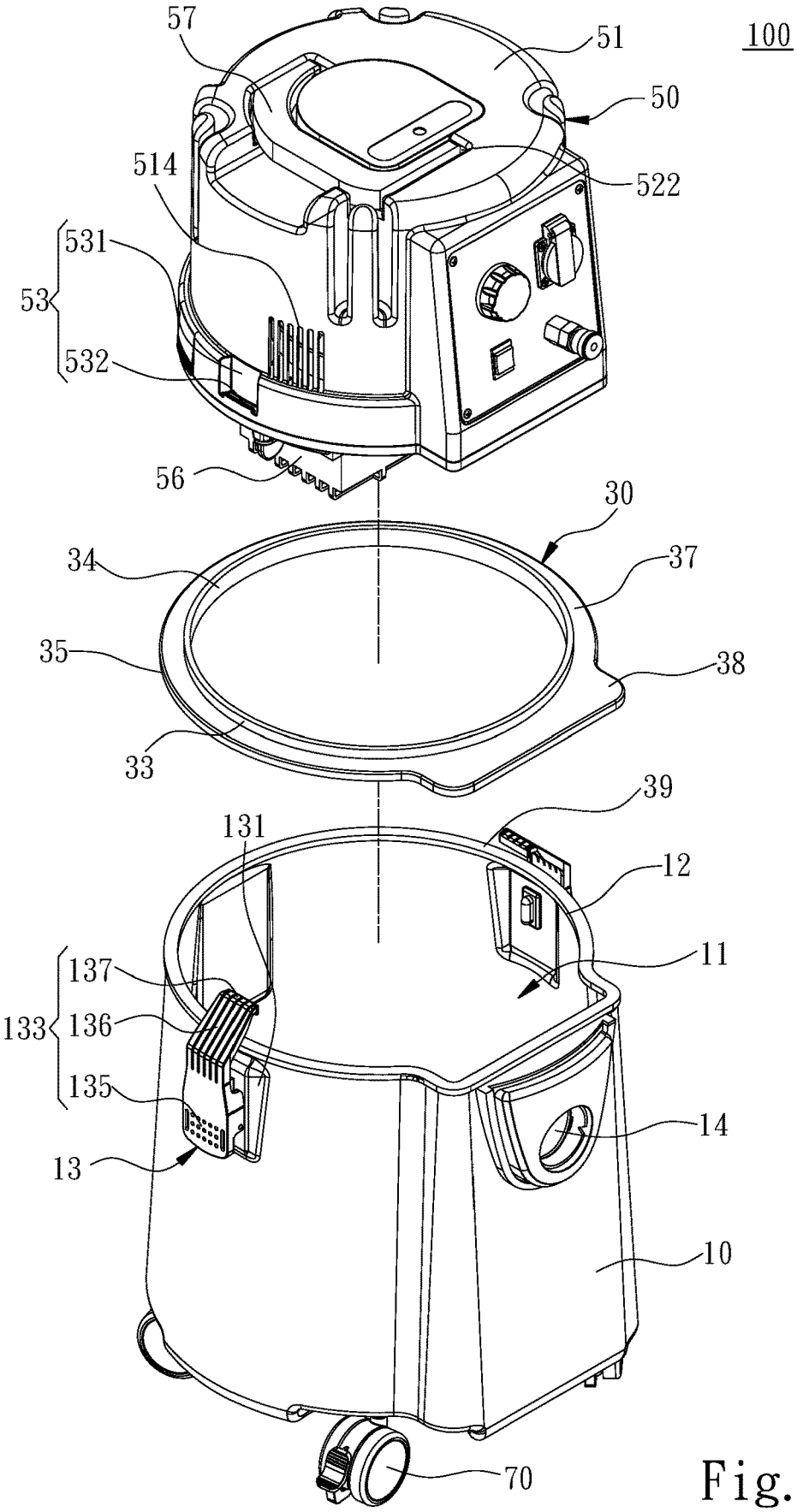
FIG. 2 is an exploded perspective view of the embodiment of the invention.
Figure 3:
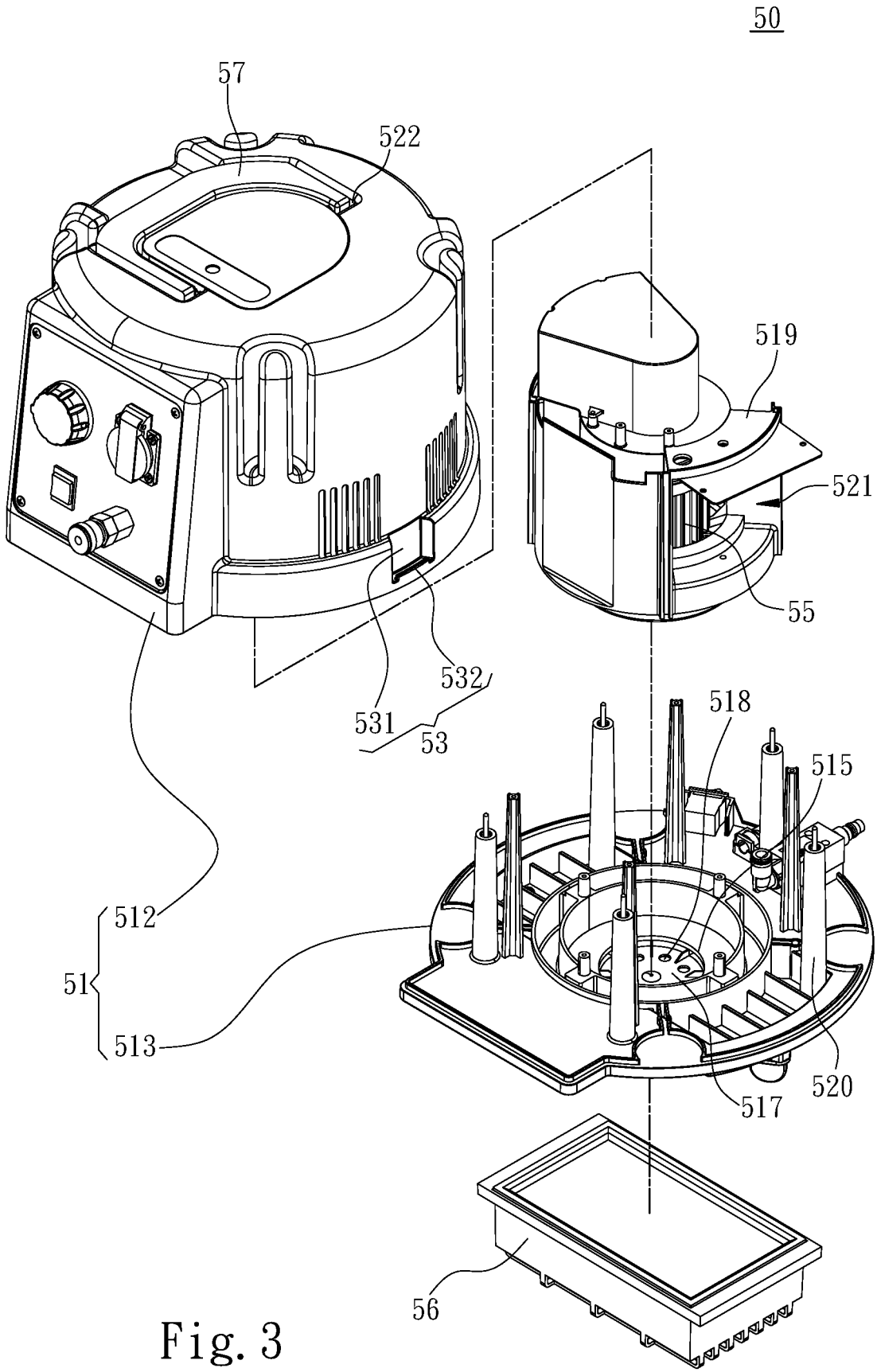
FIG. 3 is a first exploded perspective view of partial structures of the embodiment of the invention.
Figure 4:
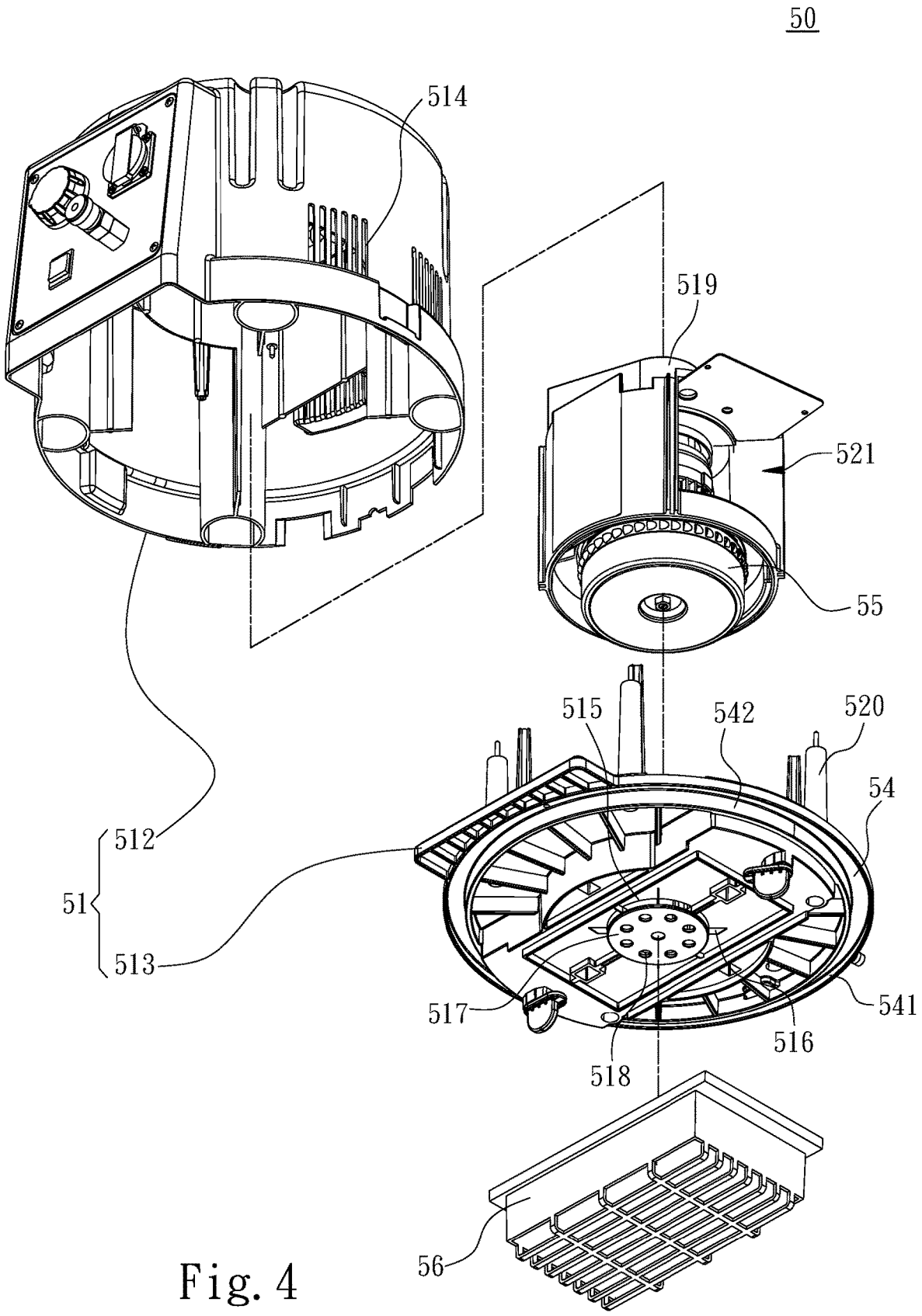
FIG. 4 is a second exploded perspective view of partial structures of the embodiment of the invention.

Further, in order for the invention to prevent the dust suction assembly 50 from separating from the dust collection barrel 10 when the dust suction assembly 50 is in the use state, each of the at least two connectors 13 comprises a base 131 fixed on an outer surface of the dust collection barrel 10, a bridge 132 pivotally connected on the base 131, and a hook 133 connected to the bridge 132, the hook 133 extends from the dust collection barrel 10 toward the shell 51 and is operable. Each of the at least two connectors 13 is manipulated through the hook 133. After the hook 133 is manipulated, the bridge 132 is pivoted relative to the base 131 and drives the hook 133 to displace towards the shell 51. In another embodiment, the at least two connecting structures 53 of the invention comprises a groove 531 formed on the shell 51, and a connecting protrusion 532 formed in the groove 531 and cooperating with one of the at least two connectors 13. The connecting protrusion 532 is disposed on a side of the groove 531, a side of the groove 531 not provided with the connecting protrusion 532 accepts the hook 133 to enter the groove 531. The hook 133 is restricted by the connecting protrusion 532 after entering the groove 531, and the hook 133 is engaged in the groove 531. Referring to FIG. 1 and FIG. 2, the hook 133 comprises a straight section 135 connected to the bridge 132, an oblique section 136 connected to the straight section 135, and a hook-shaped section 137 connected to the oblique section 136, wherein the oblique section 136 connects with the straight section 135 and the hook-shaped section 137, the oblique section 136 is inclined toward the shell 51, and enables the hook-shaped section 137 to insert into one of the at least two connecting structures 53.

Please refer to FIG. 1, FIG. 2, FIG. 3, FIG. 4, and FIG. 5, the dust suction device 100 has a dust suction function, in one embodiment, the dust collection barrel 10 includes at least one dust inlet 14 communicating with the barrel inner space 11, the dust suction assembly 50 further includes an exhaust motor 55 communicating with the dust inlet 14, and at least one dust filter 56 disposed at an air inlet side of the exhaust motor 55. Wherein the exhaust motor 55 is disposed in the shell 51, after the exhaust motor 55 is turned on, the exhaust motor 55 draws an external air containing dust from the at least one dust inlet 14. The at least one dust filter 56 is disposed on a side of the exhaust motor 55 that receives entering of the external air, the at least one dust filter 56 filters the external air, so that dust in the external air adheres to the at least one dust filter 56 or falls into the barrel inner space 11. Further, the shell 51 comprises a barrel-shaped cover 512 and a bottom plate 513 matched with the barrel-shaped cover 512, the barrel-shaped cover 512 includes at least one air outlet 514, the bottom plate 513 includes at least one air vent 515, the at least one air outlet 514 is provided for air exhausted by the exhaust motor 55 to discharge from the shell 51, and the at least one air vent 515 communicates with the barrel inner space 11 and the air inlet side of the exhaust motor 55, and enables the external air to enter the exhaust motor 55 after being filtered.

The bottom plate 513 includes a plurality of supporting ribs 516 disposed around the at least one air vent 515, and a secondary air passage plate 517 connected to the plurality of supporting ribs 516. The plurality of supporting ribs 516 are disposed separately, the plurality of supporting ribs 516 are disposed radially with the at least one air vent 515 as a center, the secondary air passage plate 517 faces the at least one air vent 515, and the secondary air passage plate 517 does not block the at least one air vent 515. The secondary air passage plate 517 is disposed on the bottom plate 513 through connecting the plurality of supporting ribs 516 and faces the at least one air vent 515, and a distance between the secondary air passage plate 517 and the bottom plate 513 is determined by heights of the plurality of supporting ribs 516. A plurality of through holes 518 are formed on the secondary air passage plate 517. A projection of the at least one air vent 515 projected on the plurality of through holes 518 covers the plurality of through holes 518. The plurality of through holes 518 directly communicate with the at least one air vent 515. Further, the shell 51 comprises an inner cover 519 provided for positioning the exhaust motor 55, and a plurality of assembly columns 520 disposed on a periphery of the inner cover 519. The inner cover 519 does not completely close the exhaust motor 55, the inner cover 519 forms at least one air passage hole 521 that provides communication with the at least one air outlet 514. Air discharged by the exhaust motor 55 flows through the at least one air passage hole 521 and flows toward the at least one air outlet 514. The plurality of assembly columns 520 are disposed along a periphery of the inner cover 519 and extend from the bottom plate 513 toward the barrel-shaped cover 512, and the plurality of assembly columns 520 assemble the bottom plate 513 with the barrel-shaped cover 512.

In order to facilitate carriage of the dust suction assembly 50 of the invention, in one embodiment, the dust suction assembly 50 comprises a handle 57 mounted on the shell 51. Further, in order to accommodate the handle 57 of the invention, in one embodiment, the shell 51 includes an accommodating groove 522 in which the handle 57 is accommodated therein, and a depth of the accommodating groove 522 is at least matched with the handle 57. In this way, when the handle 57 is accommodated in the accommodating groove 522, a top surface of the shell 51 is substantially flat (as shown in FIG. 5) to facilitate placing the dust suction device 100 upside down in the barrel inner space 11. In another embodiment, the dust suction device 100 includes a plurality of wheels 70 disposed on a bottom of the dust collection barrel 10 for convenience of transportation.

What is claimed is:

1. A dust suction device with a storage state, comprising:

a dust collection barrel, comprising a barrel inner space, an assembling opening communicating with the barrel inner space, and at least two connectors disposed on an outer surface of the dust collection barrel and adjacent to the assembling opening, the assembling opening having an opening diameter;

a supporting ring placed at the assembling opening, comprising a ring outer diameter larger than the opening diameter, and a ring inner diameter; and a dust suction assembly, comprising a shell, and at least two connecting structures formed on an outer surface of the shell, the at least two connecting structures being provided for directly assembling with the at least two connectors to restrict the dust suction assembly from separating from the dust collection barrel, the shell having at least one shell outer diameter, a maximum of the at least one shell outer diameter being smaller than the opening diameter, the at least one shell outer diameter being larger than the ring inner diameter, the dust suction assembly having a use state that the supporting ring is provided as a base of the dust suction assembly to stack the dust suction assembly above the dust collection barrel, and a storage state of being placed into a bottom part of the barrel inner space and being completely stored in the barrel inner space;

wherein the supporting ring is separable from the dust collection barrel and the dust suction assembly without disassembling the dust suction assembly, wherein the at least two connectors extend from an outer surface of the dust collection barrel over an outer perimeter of the supporting ring to connect directly with the at least two connecting structures of the dust suction assembly.

2. The dust suction device with the storage state as claimed in claim 1, wherein the supporting ring includes an auxiliary positioning rib disposed on a side facing the dust suction assembly.

3. The dust suction device with the storage state as claimed in claim 2, wherein the supporting ring includes an assembly groove disposed on a side facing the dust collection barrel and matched with the assembling opening, and a seal member t disposed in the assembly groove.

4. The dust suction device with the storage state as claimed in claim 2, wherein the at least two connecting structures comprises a groove formed on the shell, and a connecting protrusion formed in the groove and cooperating with one of the at least two connectors.

5. The dust suction device with the storage state as claimed in claim 2, wherein the shell comprises a barrel-shaped cover and a bottom plate matched with the barrel-shaped cover, and the bottom plate includes at least one air vent communicating with the barrel inner space.

6. The dust suction device with the storage state as claimed in claim 5, wherein the bottom plate has a plurality of supporting ribs disposed around the at least one air vent, and a secondary air passage plate connected to the plurality of supporting ribs and facing the at least one air vent, and a plurality of through holes are formed on the secondary air passage plate.

7. The dust suction device with the storage state as claimed in claim 2, wherein the dust suction assembly comprises a handle mounted on the shell, and the shell includes an accommodating groove accommodating the handle.

8. The dust suction device with the storage state as claimed in claim 2, wherein each of the at least two connectors comprises a base fixed on the outer surface of the dust collection barrel, a bridge pivotally connected on the base, and a hook connected to the bridge.

9. The dust suction device with the storage state as claimed in claim 8, wherein the hook comprises a straight section connected to the bridge, an oblique section connected to the straight section, and a hook-shaped section connected to the oblique section, and wherein the oblique section is inclined toward the shell with respect to the straight section.

10. The dust suction device with the storage state as claimed in claim 1, wherein the barrel inner space has at least one barrel inner diameter, and the at least one barrel inner diameter is greater than or equal to the opening diameter.

* * * * *